US005183684A

United States Patent [19]

Carpenter

[11] Patent Number: 5,183,684

[45] Date of Patent: Feb. 2, 1993

[54] SINGLE AND MULTILAYER COATINGS CONTAINING ALUMINUM NITRIDE

[75] Inventor: Leslie E. Carpenter, Midland, Mich.

[73] Assignee: Dow Corning Corporation, Midland, Mich.

[21] Appl. No.: 438,859

[22] Filed: Nov. 20, 1989

[51] Int. Cl.[5] ..... B05D 3/06; B05D 3/02; C23C 16/00

[52] U.S. Cl. ..... 427/574; 427/126.1; 427/126.2; 427/226; 427/240; 427/255; 427/255.2; 427/343; 427/344; 427/380; 427/419.7; 427/420; 427/421; 427/430.1; 427/578; 437/231; 437/235; 437/241

[58] Field of Search ..... 427/226, 38, 39, 126.2, 427/255.2, 255, 380, 419.2, 431, 420, 419.7, 421, 126.1, 343, 344; 437/231, 235, 241; 428/689, 698, 699, 701

[56] References Cited

U.S. PATENT DOCUMENTS

| | | | |
|---|---|---|---|
| 3,926,702 | 12/1975 | Oki et al. | 427/226 |
| 4,753,855 | 6/1988 | Haluska et al. | 428/702 |
| 4,756,977 | 7/1988 | Haluska et al. | 428/704 |
| 4,777,060 | 10/1988 | Mayr et al. | 427/126.1 |
| 4,833,103 | 5/1989 | Agostinelli et al. | 427/226 |

OTHER PUBLICATIONS

"A Thermoplastic Organoaluminum Precursor of Aluminum Nitride," Am. Ceram. Soc., Electronics Div., Denver (1987).

Interrant et al, "Studies of Organometallic Precursors to Aluminum Nitride," Mat. Res. Soc. Symp. Proc., 73 Better Ceram. Through Chem. 2, pp. 359-366 (1986).

*Primary Examiner*—Janyce Bell

*Attorney, Agent, or Firm*—Timothy W. Hagan

[57] ABSTRACT

Ceramic or ceramic-like single, two, or multilayer coatings having aluminum nitride as one of the layers are provided, including methods for the preparation of such coatings which produce planarizing, passivating and hermetic barrier coatings on temperature sensitive substrates such as semiconductors and electronic devices. The aluminum nitride ceramic or ceramic-like coating is provided by applying a liquid alkylaluminum amide having the formula $(R_2AlNH_2)_3$, where R is an alkyl group containing from 1 to 4 carbon atoms, neat or diluted in an organic solvent. The liquid coating is then dried, followed by heating the coating to a temperature of between about 400° to about 100° C. in the presence of ammonia to produce an aluminum nitride-containing ceramic coating.

34 Claims, No Drawings

SINGLE AND MULTILAYER COATINGS CONTAINING ALUMINUM NITRIDE

BACKGROUND OF THE INVENTION

This invention relates to ceramic methods of coating substrates, and the substrates coated thereby, and more particularly to the low temperature formation of single layer and multilayer ceramic coatings containing aluminum nitride on various substrates.

It is desirable for electronic circuits, devices and other nonmetallic substrate materials to be serviceable under a range of environmental conditions. Further, many of the uses for electronic devices today place a premium on size and weight. For example, electronic circuits used in spacecraft, satellites, and military aircraft need not only to be able to withstand a wide variety of environmental conditions, but also must be compact and lightweight in use. In order to protect such devices and substrates from heat, moisture, ionic impurities, and abrasive forces, the art has resorted to a number of methods to coat the devices and substrates to prevent, or at least minimize, the exposure of the devices or substrates to these environmental conditions.

Early attempts at protecting electronic circuitry included potting the circuits in polymeric resins. However, these techniques added considerable thickness and weight to the circuits. Also, the polymeric coatings tended to absorb moisture from the environment which could eventually lead to damage or failure of the circuits. Presently, some circuits are contained in ceramic packages to protect them from environmental exposure. While the ceramic packages are relatively secure, they add a substantial amount of thickness and weight to the circuit. Further, they are relatively expensive to fabricate.

Others have applied passivating coatings to the surfaces of such substrates. Common causes for the failure of electronic devices is the formation of microcracks or voids in the surface passivation layer of the device, such as a semiconductor chip, permitting the introduction of impurities from the environment. For example, sodium ($Na+$) and chloride ($Cl-$) ions may enter electronic devices and disrupt the transmission of electrical signals. Additionally, the presence of moisture and volatile organic chemicals may also adversely affect the performance of electronic devices. A single coating material or layer may be insufficient to meet the ever increasing demands placed on the material by the electronics industry. Several coating properties such as microhardness, moisture resistance, ion barrier, adhesion, ductility, tensile strength, and thermal expansion coefficient matching must be achieved through the use of a number of thin protective layers on the electronic device.

More recently, lightweight single layer and multilayer ceramic coatings have been developed for coating electronic devices. For example, Haluska et al, in U.S. Pat. Nos. 4,753,855 and 4,756,977, teach the formation of ceramic coatings by producing a solvent mixture of a hydrogen silsesquioxane resin alone or in combination with a metal oxide precursor which is then coated onto the surface of an electronic device. The coating is ceramified at temperatures between about 200° to 1000° C. to form a silicon dioxide-containing ceramic coating. Additional coating layers of ceramic materials are also taught to provide additional protection and coating properties. These additional layers may comprise additional ceramic or ceramic-like coatings containing silicon, silicon and carbon, or silicon, carbon, and nitrogen.

The high refractory and chemically resistant nature of aluminum nitride coupled with other properties such as a large energy gap, a high thermal conductivity, and a closely matched thermal expansion to silicon make it an attractive prospective material for use in microelectronic packaging for the protection and passivation of electronic devices. While aluminum nitride has been prepared in powder form for the casting of larger parts, it has also been formed as a thin film by various chemical and physical vapor deposition procedures in the past.

For example, Tebbe et al, "A Thermoplastic Organoaluminum Precursor of Aluminum Nitride", Am. Ceram. Soc., Electronics Div., Denver (1987), teach the formation of an organoaluminum polymer from the reaction of triethylaluminum and ammonia which can be solidified, cured, and pyrolyzed to form aluminum nitride. Interrante et al, "Studies of Organometallic Precursors to Aluminum Nitride," Mat. Res. Soc. Symp. Proc., 73 Better Ceram. Through Chem. 2, pp. 359-66 (1986), teach the chemical vapor deposition of aluminum nitride using an organoaluminum amide intermediate. Others in the art have used reactive cathodic sputtering, glow discharge, vacuum deposition, or reactive ion beam deposition to form thin films of aluminum nitride.

A major drawback to these prior art techniques for forming thin aluminum nitride films is that they are relatively slow processes which require extended periods of time to build up even 1 to 10 micrometer layer thicknesses. Further, many of these prior art techniques must be carried out at very high temperatures, requiring the use of furnacing equipment and/or vacuum equipment. Additionally, such deposition techniques do not planarize or level the substrate surface but instead provide only conformal coverage of substrate surfaces, leaving discontinuities or thin spots in the coating.

Accordingly, the need still exists in the art for a simple, rapid, low temperature procedure for producing thin films of aluminum nitride on temperature sensitive substrates such as electronic devices, either alone or in combination with other protective layers.

SUMMARY OF THE INVENTION

The present invention meets that need by providing ceramic or ceramic-like single, two, or multilayer coatings having aluminum nitride as one of the layers. The present invention also includes methods for the preparation of such coating which produce planarizing, passivating and/or hermetic barrier coatings on temperature sensitive substrates such as semiconductors and electronic devices. The coatings of the present invention may also serve as functional layers in such electronic devices.

In accordance with one aspect of the present invention, a process for the formation of an aluminum nitride ceramic or ceramic-like single layer coating on a substrate is provided and includes the steps of coating the substrate with a liquid containing an alkylaluminum amide having the general formula $(R_2AlNH_2)_3$, where R is an alkyl group containing from 1 to 4 carbon atoms. The alkylaluminum amide may be applied neat for those alkylaluminum amides which are liquids, or diluted in an organic solvent. The organic solvent is preferably a nonreactive hydrocarbon compound.

The liquid coating is then dried to thereby deposit a preceramic coating on the substrate. This is followed by ceramifying the preceramic coating to an aluminum nitride-containing ceramic by heating the preceramic coating to a temperature of between about 400° to about 1000° C. in the presence of ammonia. The ammonia may be present either as a pure ammonia atmosphere, or as an otherwise inert atmosphere containing preferably at least 10% by volume of ammonia.

The liquid alkylaluminum amide, or solution containing the alkylaluminum amide, may be coated onto the substrate by any of a number of conventional techniques such as spray coating, dip coating, flow coating, or spin coating. In a preferred embodiment of the invention, the substrate is an electronic device. Preferably, the coating is applied to a thickness of between about 50 to about 500 nanometers.

The present invention also relates to an article, such as an electronic device, prepared by the above-described process. The electronic device may have a structure in which the coating prepared by the process of the present invention is used as either a planarizing layer, a passivating layer or a hermetic barrier layer. When used as an initial planarizing layer, the liquid alkylaluminum amide coating is particularly suited to fill in and level out surface irregularities on the substrate.

In another embodiment of the invention, a process for the formation of a multilayer ceramic or ceramic-like coating on a substrate is provided including the steps of coating the substrate with a planarizing coating comprising a liquid containing an alkylaluminum amide having the formula $(R_2AlNH_2)3$, where R is an alkyl group containing from 1 to 4 carbon atoms. The liquid coating is then dried to thereby deposit a preceramic coating on the substrate. This is followed by ceramifying the preceramic coating to an aluminum nitride-containing ceramic by heating the preceramic coating to a temperature of between about 400° to about 1000° C. in the presence of ammonia to form the planarizing coating.

A passivating coating is then applied to the planarizing coating, preferably using chemical vapor deposition (CVD), plasma enhanced chemical vapor deposition (PECVD), or metal assisted CVD techniques. The passivating coating may be selected from the group consisting of (i) a silicon nitrogen-containing coating, (ii) a silicon-containing coating, and (iii) a silicon carbon nitrogen-containing coating. Finally, a silicon-containing coating is applied to the passivating coating by applying to said passivating coating a protective coating selected from the group consisting of (i) a silicon-containing coating, (ii) a silicon nitrogen-containing coating, (iii) a silicon carbon-containing coating, and (iv) a silicon carbon nitrogen-containing coating, thereby forming a multilayer ceramic or ceramic-like coating.

Where the passivating coating is a silicon nitrogen-containing coating, it is preferably applied onto the planarizing coating by a means selected from the group consisting of (a) chemical vapor deposition of a silane, halosilane, halodisilane, halopolysilane or mixtures thereof in the presence of ammonia, (b) plasma enhanced chemical vapor deposition of a silane, halosilane, halodisilane, halopolysilane or mixtures thereof in the presence of ammonia, and (c) ceramification of a silicon and nitrogen-containing polymer. Where the passivating coating is a silicon carbon nitrogen-containing coating, it is preferably applied onto the planarizing coating by a means selected from the group consisting of (1) chemical vapor deposition of hexamethyldisilazane, (2) plasma enhanced chemical vapor deposition of hexamethyldisilazane, (3) chemical vapor deposition of a silane, halosilane, halodisilane, halopolysilane or mixture thereof in the presence of an alkane of one to six carbon atoms or an alkylsilane, and further in the presence of ammonia, and (4) plasma enhanced chemical vapor deposition of a silane, halosilane, halodisilane, halopolysilane or mixture thereof in the presence of an alkane of one to six carbon atoms or an alkylsilane, and further in the presence of ammonia. Where the passivating coating is a silicon carbon-containing coating, it is preferably deposited by a means selected from the group consisting of (i) chemical vapor deposition of a silane, halosilane, halopolysilane, or mixtures thereof in the presence of an alkane of one to six carbon atoms or an alkylsilane, and (ii) plasma enhanced chemical vapor deposition of a silane, alkylsilane, halosilane, halodisilane, halopolysilane, or mixtures thereof in the presence of an alkane of one to six carbon atoms or an alkylsilane.

In forming the protective coating, where the protective coating is a silicon-containing coating, it is preferably applied onto the passivating coating by a means selected from the group consisting of (a) chemical vapor deposition of a silane, halosilane, halopolysilane, or mixtures thereof, (b) plasma enhanced chemical vapor deposition of a silane, halosilane, halopolysilane, or mixtures thereof, or (c) metal assisted chemical vapor deposition of a silane, halosilane, halopolysilane, or mixtures thereof. Where the protective coating is a silicon carbon-containing coating, it is preferably applied by a means selected from the group consisting of (1) chemical vapor deposition of a silane, alkylsilane, halosilane, halodisilane, halopolysilane, or mixtures thereof in the presence of an alkane of one to six carbon atoms or an alkylsilane, (2) plasma enhanced chemical vapor deposition of a silane, alkylsilane, halosilane, halodisilane, halopolysilane, or mixtures thereof in the presence of an alkane of one to six carbon atoms or an alkylsilane. Where the protective coating is a silicon nitrogen-containing coating, it is preferably deposited by a means selected from the group consisting of (A) chemical vapor deposition of a silane, halosilane, halodisilane, halopolysilane or mixtures thereof in the presence of ammonia, (B) plasma enhanced chemical vapor deposition of a silane, halosilane, halodisilane, halopolysilane or mixtures thereof in the presence of ammonia, and (C) ceramification of a silicon and nitrogen-containing preceramic polymer. Where the protective coating is a silicon carbon nitrogen-containing coating, it is preferably deposited by a means selected from the group consisting of (i) chemical vapor deposition of hexamethyldisilazane, (ii) plasma enhanced chemical vapor deposition of hexamethyldisilazane, (iii) chemical vapor deposition of a silane, alkylsilane, halosilane, halodisilane, halopolysilane, or mixtures thereof in the presence of an alkane of one to six carbon atoms or an alkylsilane and further in the presence of ammonia, and (iv) plasma enhanced chemical vapor deposition of a silane, alkylsilane, halosilane, halodisilane, halopolysilane, or mixtures thereof in the presence of an alkane of one to six carbon atoms or an alkylsilane and further in the presence of ammonia.

As described above, the liquid alkylaluminum amide or alkylaluminum amide in solvent solution may be coated onto the substrate by a number of conventional techniques including spray coating, dip coating, flow coating, or spin coating. In a preferred embodiment of the multilayer embodiment of the invention, the substrate is an electronic device. Preferably, the aluminum nitride planarizing coating has a thickness of between about 50 to about 500 nanometers. The multilayer embodiment of the present invention also relates to an article, such as an electronic device, prepared by the above-described process.

In another embodiment of the invention, aluminum nitride is applied as a passivating layer over an initial planarizing layer of a silicon dioxide-containing ceramic material. In this embodiment, a multilayer ceramic or ceramic-like protective coating is formed on a substrate by initially coating the substrate with a planarizing coating of a silicon dioxide-containing ceramic or ceramic-like composition. Then, a passivating coating comprising a liquid containing an alkylaluminum amide having the formula $(R_2AlNH_2)_3$, where R is an alkyl group containing from 1 to 4 carbon atoms is applied to the planarizing coating.

The liquid is then dried to form a preceramic coating followed by the ceramification of the preceramic coating to an aluminum nitride-containing ceramic by heating the preceramic coating to a temperature of between about 400° to about 1000° C. in the presence of ammonia to form the passivating coating. To the passivating coating, a protective coating is then applied selected from the group consisting of (i) a silicon-containing coating, (ii) a silicon nitrogen-containing coating, (iii) a silicon carbon-containing coating, and (iv) a silicon carbon nitrogen-containing coating, whereby a multilayer ceramic or ceramic-like coating on the substrate is obtained.

The planarizing coating of a silicon dioxide containing ceramic or ceramic-like material is preferably applied onto the substrate by a means selected from the group consisting of (a) deposition of a hydrogen silsesquioxane resin from a solvent solution, with or without a catalyst, drying, and ceramification, (b) deposition of a mixture of a hydrogen silsesquioxane resin and one or more metal oxides from a solvent solution, with or without a catalyst, drying, and ceramification, (c) deposition of a silicate ester from a solvent solution, drying, and ceramification, (d) deposition of a mixture of a silicate ester and one or more metal oxides from a solvent solution, drying, and ceramification, (e) deposition of a nitrided hydrogen silsesquioxane resin from a solvent solution, with or without a catalyst, drying, and ceramification, and (f) deposition of a mixture of a nitrided hydrogen silsesquioxane resin and one or more metal oxides from a solvent solution, with or without a catalyst, drying, and ceramification.

In another embodiment of the invention, the aluminum nitride may be applied as a top hermetic barrier coating over previously applied planarizing and/or passivating coatings. Where the aluminum nitride is to be used as a barrier coating, preferably it is applied by chemical vapor deposition techniques to produce a dense coating. In this embodiment of the invention, a multilayer ceramic or ceramic-like protective coating on a substrate is formed by initially coating the substrate with a planarizing coating of a silicon dioxide containing ceramic or ceramic-like composition.

To the planarizing coating, a passivating coating selected from the group consisting of (i) a silicon nitrogen-containing coating, (ii) a silicon carbon-containing coating, and (iii) a silicon carbon nitrogen-containing coating is applied. This is followed by the application of a protective barrier coating of aluminum nitride by the chemical vapor deposition of a 5 preceramic composition containing an alkylaluminum amide having the formula $(R_2AlNH_2)_3$, where R is an alkyl group containing from 1 to 4 carbon atoms at a temperature of between about 400° to about 1000° C. in the presence of ammonia to form the protective coating. In this embodiment of the invention, pyrolysis and ceramification take pace during the deposition of the coating.

In another embodiment of the invention, an aluminum nitride layer is sandwiched between layers of silicon, silicon carbon, silicon nitrogen, or silicon carbon nitrogen-containing materials. In that process, a multilayer ceramic or ceramic-like protective coating is provided on a substrate by coating the substrate with an initial coating of a ceramic or ceramic-like composition selected from the group consisting of (i) a silicon nitrogen-containing coating, (ii) a silicon carbon-containing coating, and (iii) a silicon carbon nitrogen-containing coating.

A passivating coating is then applied over the planarizing coating by applying a liquid containing an alkylaluminum amide having the formula $(R_2AlNH_2)_3$, where R is an alkyl group containing from 1 to 4 carbon atoms, drying the liquid to deposit a preceramic coating on the substrate, and then ceramifying the preceramic coating to an aluminum nitride-containing ceramic by heating the preceramic coating to a temperature of between about 400° to about 1000° C. in the presence of ammonia to form the passivating coating.

Lastly, a protective coating is applied, that coating being selected from the group consisting of (i) a silicon-containing coating, (ii) a silicon nitrogen-containing coating, (iii) a silicon carbon-containing coating, and (iv) a silicon carbon nitrogen-containing coating, whereby a multilayer ceramic or ceramic-like coating on the substrate is obtained.

In yet another embodiment of the invention, a process for the formation of a two layer ceramic or ceramic-like coating on a substrate is provided including the steps of coating the substrate with a planarizing coating comprising a liquid containing an alkylaluminum amide having the formula $(R_2AlNH_2)_3$, where R is an alkyl group containing from 1 to 4 carbon atoms. The liquid is then dried to deposit a preceramic coating on the substrate. Then, the preceramic coating is ceramified to an aluminum nitride-containing ceramic by heating the preceramic coating to a temperature of between about 400° to about 1000° C. in the presence of ammonia to form the planarizing coating.

A passivating coating is then applied to the planarizing coating. The passivating coating is preferably selected from the group consisting of (i) a silicon nitrogen-containing coating, and (ii) a silicon-containing coating, whereby a two layer ceramic or ceramic-like coating is obtained.

As described above, the liquid solution containing the alkylaluminum amide may be coated onto the substrate by a number of conventional techniques including spray coating, dip coating, flow coating, or spin coating. In a preferred embodiment of the two layer embodiment of the invention, the substrate is an electronic device. Preferably, the planarizing coating has a thickness of between about 50 to about 500 nanometers. The two layer embodiment of the present invention also relates to an article, such as an electronic device, prepared by the above-described process.

In still another embodiment of the invention, a process is provided for the formation of a two layer ceramic or ceramic-like protective coating on a substrate by coating the substrate with a planarizing coating of a silicon dioxide containing ceramic or ceramic-like composition. Then, a protective coating of aluminum nitride is applied over the planarizing coating by the chemical vapor deposition of a preceramic composition containing an alkylaluminum amide having the formula $(R_2AlNH_2)_3$, where R is an alkyl group containing from 1 to 4 carbon atoms at a temperature of between about 400° to about 1000° C. in the presence of ammonia to form the protective coating. In this embodiment of the invention, pyrolysis and ceramification of the aluminum nitride-containing coating occurs during deposition.

In yet another embodiment of the invention, a Process for the formation of a two layer ceramic or ceramic-like protective coating on a substrate is provided by coating the substrate with an initial coating of a ceramic or ceramic-like composition selected from the group consisting of (i) a silicon nitrogen-containing coating, (ii) a silicon carbon-containing coating, and (iii) a silicon carbon nitrogen-containing coating. Then, a protective coating of aluminum nitride is applied over the planarizing coating by the chemical vapor deposition of a preceramic composition containing an alkylaluminum amide having the formula $(R_2AlNH_2)_3$, where R is an alkyl group containing from 1 to 4 carbon atoms at a temperature of between about 400° to about 1000° C. in the presence of ammonia to form the protective coating.

Accordingly, it is an object of the present invention to provide an aluminum nitride ceramic or ceramic-like coating, alone or in combination with other ceramic or ceramic-like coatings, and a method for its preparation which produces planarizing, passivating, and/or barrier protective coatings on sensitive substrates such as electronic devices. This, and other objects and advantages of the present invention, will become apparent from the following detailed description and the appended claims.

DETAILED DESCRIPTION OF THE PREFERRED EMBODIMENTS

The present invention utilizes a liquid containing an aluminum nitride precursor, alone or in combination with silicon containing ceramic materials, for the formation of planarizing, passivating, protective, and/or functional coatings on substrates. The present invention is particularly useful in providing a protective single layer or multilayer coating to heat sensitive substrates such as electronic devices and circuits. This is accomplished by coating a liquid containing an alkylaluminum amide onto the surface of the substrate and then heating the coating in the presence of ammonia to ceramify the coating. The choice of substrates to be coated by the present invention is limited only by the need for thermal and chemical stability of the substrate during the ceramification procedure.

The coatings of the present invention are useful not only as protective coatings to protect electronic devices from the environment but also as protective layers on other heat sensitive nonmetallic substrates. The coatings may also serve as dielectric layers, doped dielectric layers to produce transistor-like devices, pigment loaded binder systems containing silicon to produce capacitors and capacitor-like devices, multilayer devices, 3-D devices, silicon-on-insulator (SOI) devices, super lattice devices, and the like.

As used in the present invention, the term "ceramic-like" refers to those pyrolyzed materials which are not fully free of residual carbon and/or hydrogen but which are otherwise ceramic in character. Also, the terms "electronic device" and "electronic circuit" are meant to include, but not be limited to, such devices and circuits as silicon-based devices, gallium arsenide-based devices, focal plane arrays, opto-electronic devices, photovoltaic cells, optical devices, dielectric layers, doped dielectric layers to produce transistor-like devices, pigment loaded binder systems containing silicon to produce capacitors and capacitor-like devices, multilayer devices, 3-D devices, silicon-on-insulator devices, and super lattice devices.

In accordance with the present invention, an aluminum nitride coating may be formed, either as an initial planarizing layer, an intermediate layer, or a top layer in a two or multilayer construction. A preferred method of applying the aluminum nitride is by applying a liquid containing an alkylaluminum amide having the formula $(R_2AlNH_2)_3$, where R is an alkyl group containing from 1 to 4 carbon atoms. Where R is ethyl, a liquid diethylaluminum amide is formed which can be applied neat without the need for a solvent.

For other of the alkylaluminum amides, it is preferred that the compound be dissolved in a solvent of a nonreactive hydrocarbon such as toluene or heptane. The concentration of alkylaluminum amide in the solvent is preferably between about 10 to 99.9 %. The use of a solvent solution permits the viscosity of the alkylaluminum amide to be controlled, which affects the thickness of the coating which forms. Thicknesses of between about 50 to about 500 nanometers are preferred.

The alkylaluminum amides used in the practice of the present invention may be prepared by reacting the appropriate alkylaluminum compound such as trialkyl aluminum ($R_3Al$) with ammonia in accordance with the teachings of E. Wiberg, in G. Bahr, FIAT Review of German Science, vol. 24 Inorganic Chemistry, part 2, W. Klemm ed. (1948), page 155, or Interrante et al, "Studies of Organometallic Precursors to Aluminum Nitride," Mat. Res. Soc. Symp. Proc., 73 Better Ceram. Through Chem. 2, pp. 359–66 (1986), the disclosures of which are incorporated by reference.

The preceramic liquid solution, with or without solvent, is coated onto the substrate, and the solvent, if any, is allowed to evaporate under ambient conditions. The preceramic coating may be applied by any of a number of convenient techniques, including, but not limited to, spin coating, dip coating, spray coating, or flow coating. When a spin coating technique is used, the speed at which the coating is spun affects the thickness of the coating which forms. It should be understood that the coating may be formed by multiple applications of the liquid solution either prior to ceramification or with ceramification prior to each further coating application.

By this means, a planarizing preceramic coating is deposited which may then be ceramified by exposing the coating to an atmosphere containing ammonia at a temperature of between about 400° to about 1000° C. It has been found that an amorphous aluminum nitride forms at the lower end of this temperature range while a crystalline aluminum nitride forms at the upper end of the range. The atmosphere may be pure ammonia, or be an otherwise inert atmosphere which contains from about 10 to about 100 vol. % ammonia.

The planarizing coating of aluminum nitride thus produced may then be coated with one or more additional ceramic or ceramic-like coatings which may act as passivating layers, barrier layers to diffusion, abrasion resistant protective layers, or the like. Such additional coating layers also provide resistance against ionic impurities such as chlorides. Such additional layers may contain silicon, silicon and carbon, silicon and oxygen, silicon and nitrogen, or silicon, carbon, and nitrogen. They may be applied using chemical vapor deposition, plasma enhanced chemical vapor deposition, metal assisted vapor deposition, or other techniques.

Alternatively, the aluminum nitride coating may itself be applied over an initial planarizing layer of another ceramic and form an intermediate passivating or barrier layer. Where the aluminum nitride is to be used as a barrier layer or top protective layer, it is preferred that it be deposited using chemical vapor deposition techniques such as those taught in the above-described Interrante article.

Where a silicon and nitrogen containing coating is utilized, preceramic silicon nitrogen-containing polymers suitable for use in the present invention are well known in the art and include silazanes, disilazanes, polysilazanes, and cyclic silazanes. Other suitable materials which may be utilized are described in Haluska et al, U.S. Pat. Nos. 4,822,697; 4,756,977; 4,749,631; 4,753,855; 4,753,856; and 4,808,653, the disclosures of which are incorporated by reference. Such preceramic polymers must be capable of conversion to a ceramic or ceramic-like material at elevated temperatures.

A coating of the preceramic silicon and nitrogen-containing polymer may be applied by first diluting the polymer to a low solids (i.e., 0.1 to 10.0 weight %) solution in an organic solvent such as n-heptane or toluene. The polymer-containing solution is then coated onto the surface of any previously applied coatings on the substrate using any suitable conventional technique such as spin coating, dip coating, spray coating, or flow coating and the solvent allowed to evaporate. The thus deposited preceramic coating is then ceramified by heating. Thin ceramic or ceramic-like coatings having a thickness of between about 1 to about 1500 nanometers may be produced by this method.

A coating of the preceramic silicon and oxygen containing polymer may be applied by the use of a hydrogen silsesquioxane resin $(HSiO_{3/2})_n$ which is diluted with a solvent such as n-heptane or toluene so that the concentration of hydrogen silsesquioxane in solution is from about 0.1 to about 10.0% by weight. The hydrogen silsesquioxane resin may be prepared in accordance with the teachings of Frye et al, U.S. Pat. No. 3,615,272 and Frye et al, J.Am. Chem. Soc., 92, p.5586 (1970), the disclosures of which are hereby incorporated by reference. The preceramic solvent solution is coated onto a substrate and the solvent allowed to evaporate by drying at ambient conditions. The preceramic coating may be applied by any of a number of convenient techniques including, but not limited to, spin coating, dip coating, spray coating, or flow coating. Ceramification of the coating at elevated temperatures produces a silicon dioxide containing coating. Alternatively, the hydrogen silsesquioxane resin in a solvent solution, may also contain a catalyst such as platinum or rhodium. Further, a mixture of a hydrogen silsesquioxane resin and one or more metal oxides in a solvent solution, with or without a catalyst, may be deposited using the techniques taught by Haluska et al, discussed previously. In another embodiment, a silicate ester in a solvent solution, or a mixture of a silicate ester and one or more metal oxides in a solvent solution may be deposited using techniques taught by Haluska et al.

In yet another embodiment, formation of a nitrided coating may be accomplished by deposition of a hydrogen silsesquioxane resin or a mixture of a hydrogen silsesquioxane resin and one or more metal oxides from a solvent solution, with or without a catalyst, followed by drying and ceramification in an ammonia-containing atmosphere. All of the above techniques are taught in the above-mentioned Haluska et al patents, the teachings of which have been incorporated by reference.

Alternatively, chemical vapor deposition, plasma enhanced chemical vapor deposition, and metal assisted chemical vapor deposition techniques may be used to deposit the initial and subsequent layers of coatings onto the substrate material. Thus, coatings containing silicon, silicon and carbon, silicon and nitrogen, and silicon, carbon, and nitrogen may be deposited using these techniques. A preferred method of depositing a silicon-containing top layer at a relatively low temperature is by the metal assisted chemical vapor deposition process described in Varaprath, U.S. Pat. No. 4,696,834, issued Sep. 29, 1987 and entitled "Silicon-containing Coatings and a Method for Their Preparation". The high temperature conditions of conventional chemical vapor deposition techniques may limit the type of substrates which may be coated. For example, electronic devices which cannot withstand temperatures in excess of 400° C. without damage should be coated using other than conventional chemical vapor deposition techniques.

In order that the invention may be more readily understood, reference is made to the following examples, which are intended to illustrate the invention, but are not to be taken as limiting the scope thereof.

EXAMPLE 1

Diethylaluminum amide, $(Et_2AlNH_2)_3$, was synthesized in a reaction vessel located in a glove box using the method of Wiberg, discussed previously. In a one liter reaction vessel equipped with a gas inlet tube, thermometer, and magnetic stirrer, 75 ml of diethylaluminum (Aldrich, 62.6 gm, 0.55 mole) and 300 ml of toluene (distilled from $CaH_2$) were added. While stirring, ammonia was bubbled through the reaction. During the addition of ammonia, the temperature of the reaction rose to 80° C. The ammonia addition was continued until the temperature returned to ambient, insuring that an excess of ammonia was added. The toluene solvent was then removed in vacuo to yield 59.74 gm of a clear, colorless liquid, identified to be diethylaluminum amide $(Et_2AlNH_2)_3$.

EXAMPLE 2

In the glove box, 8 gm of the diethylaluminum amide produced in Example 1 was placed in a combustion boat. The boat was then placed in a pyrolysis tube and a slow flow of ammonia was established through the tube. The temperature of the tube was raised to 400° C. at a rate of 5° C./min. The temperature of the tube was held steady for three hours and then allowed to cool to ambient temperature under a flow of argon. A ceramic aluminum nitride powder resulted. Samples of the pyrolysate were analyzed for C, H, N, and 0 content. The results were:

| | Found | Theory |
|---|---|---|
| C | 2.26% | 0% |
| H | 2.60% | 0% |
| N | 34.36% | 34.17% |
| O | 0.89% | 0% |

EXAMPLE 3

Dimethylaluminum amide, $(Me_2AlNH_2)_3$, was synthesized in the glove box in the same reaction vessel by adding 60 ml of trimethylaluminum (Aldrich, 45.12 gm, 0.626 moles) and 500 ml of freshly dried toluene. With stirring, ammonia was bubbled through the solution. The addition of ammonia caused the temperature in the reaction vessel to rise to 74° C. The addition of ammonia was continued until the temperature in the vessel returned to ambient. The toluene was removed in vacuo to yield 38.28 gm of a white solid identified as dimethylaluminum amide, $(Me_2AlNH_2)_3$.

EXAMPLE 4

The effectiveness of aluminum nitride single and two layer coatings, made in accordance with the practice of the present invention, in protecting electronic devices from environmental exposure were tested. The electronic devices tested were Motorola I4011B CMOS devices in ceramic packages with the lids removed to expose the devices. The devices were coated as explained in further detail below and then exposed continuously to a salt spray.

The exposure of the devices to salt spray was conducted in accordance with MIL-STD-883C Method 1009.6. A salt spray chamber from Associated Environmental Systems was used and equipped with proper venting and drainage, a salt water solution reservoir, and nozzles and compressed air for atomizing the salt water solution The chamber was also temperature and humidity controlled. A 0.5 weight % sodium chloride in deionized water solution was used in the reservoir.

The individual coated and uncoated control devices were placed in a Teflon (trademark of du Pont) coated rack which held the devices with their active surfaces up in an orientation of 15° from vertical on their respective long axes.

The devices were tested at 24 hour intervals to determine if they were still functioning. The results are reported in Table 1 below. The hours to failure reported represents the last interval measured in which there was a failure of the device. Thus, a reported time to failure of 48 hours means that the device failed some time between the 24th and 48th hours. As a control, eight of the same unprotected CMOS devices were exposed to the same conditions of salt spray. All of those devices failed within the first two hours of testing.

Eight of the devices were coated with a single layer of aluminum nitride using liquid solutions of diethylaluminum amide, $(Et_2AlNH_2)_3$, in toluene. Two devices, numbered 11 and 12, were coated with a 10% solution of diethylaluminum amide; two, numbered 13 and 14, with a 20% solution; two, numbered 15 and 16, with a 30% solution; and two, numbered 19 and 20, with a 50% solution. In addition, device 20 also had a second layer of a-Si applied over the aluminum nitride layer.

The diethylaluminum amide solution was applied by spin coating using a spin speed of 3000 rpm for 30 seconds. The devices and coating were pyrolyzed by heating to 400° C. in a slow flow of ammonia using a ramp rate of 5° C. per minute. The devices were held in ammonia at 400° C. for two hours and then allowed to cool to ambient temperature under a slow flow of argon.

Device 20 then had a second coating applied by the chemical vapor deposition of $F_3SiSiF_3$. All of the devices were functional after coating. As shown in the Table, one device (14) failed in the first 24 hours, one device (13) failed between 48 and 72 hours, and the remainder failed between 24 and 48 hours.

An additional ten of the CMOS devices were initially coated using a 15% heptane solution of a hydrogen silsesquioxane resin using a spin speed of 3000 rpm. The hydrogen silsesquioxane resin coating was then pyrolyzed by heating in air at 400° C. for one hour to form a silicon dioxide containing ceramic coating. A second layer of aluminum nitride was then applied over the $SiO_2$ layer in the manner described above. Devices 1 and 2 were coated with a 10% solution of diethylaluminum amide; devices 3 and 4 were coated with a 20% solution; devices 5 and 6 were coated with a 30% solution; devices 7 and 8 were coated with a 40% solution; and devices 9 and 10 were coated with a 50% solution. All were ceramified by heating in the presence of ammonia.

All of the devices were then subjected to salt spray as described above. All of the devices were functional after 24 hours, while one device remained functional after 100 hours of exposure. This is in comparison to the control devices, all of which failed within the first two hours of the test.

Five additional CMOS devices, devices numbered 21–25, were spin coated with a neat, liquid diethylaluminum amide, $(Et_2AlNH_2)_3$, solution using a 3000 rpm spin speed. The coatings were then pyrolyzed as previously described in the presence of ammonia. Device 25 had a second layer of a-Si applied by the chemical vapor deposition of $F_3SiSiF_3$. The devices were then subjected to salt spray testing. As can be seen from Table 1, one of the devices failed in the first 24 hours. However, all of the remaining devices did not fail until between 24 and 48 hours of exposure.

Five additional CMOS devices, devices numbered 26–30, were coated with a solution containing hydrogen silsesquioxane resin as described above. The coating was ceramified to a silicon dioxide containing layer. To these devices was coated a second layer using a neat liquid diethylaluminum amide, $(Et_2AlNH_2)_3$, solution using a 3000 rpm spin speed. They coatings were then pyrolyzed as previously described in the presence of ammonia. When subjected to salt spray testing, four of the five devices remained functional after 100 hours, while the other device failed between 72 and 96 hours.

TABLE 1

| Device No. | Coating | Hours to Failure |
|---|---|---|
| 1 | $SiO_2$—AlN | 96 |
| 2 | " | 72 |
| 3 | " | 48 |
| 4 | " | 48 |
| 6 | " | DNF* |
| 8 | " | 96 |
| 9 | " | 72 |
| 10 | " | 96 |
| 11 | AlN | 48 |
| 12 | " | 48 |
| 13 | " | 72 |
| 14 | " | 24 |
| 15 | " | 48 |
| 16 | " | 48 |

TABLE 1-continued

| Device No. | Coating | Hours to Failure |
|---|---|---|
| 19 | " | 48 |
| 20 | AlN-a-Si | 48 |
| 21 | AlN | 48 |
| 22 | " | 48 |
| 23 | " | 24 |
| 24 | " | 48 |
| 25 | AlN-a-Si | 48 |
| 26 | $SiO_2$—AlN | DNF |
| 27 | " | DNF |
| 28 | " | 96 |
| 29 | " | DNF |
| 30 | " | DNF |

*Device did not fail after 100 hours of exposure Devices 5, 7, 17, and 18 were mechanically damaged during coating and were not tested.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A process for the formation of an aluminum nitride ceramic or ceramic-like coating on a substrate comprising the steps of:

(a) coating said substrate with a liquid containing an alkylaluminum amide having the formula $(R_2AlNH_2)_3$, where R is an alkyl group containing from 1 to 4 carbon atoms;

(b) drying said liquid and thereby depositing a preceramic coating on said substrate; and (c) ceramifying said preceramic coating to an aluminum nitride-containing ceramic by heating said preceramic coating to a temperature of between about 400° to about 1000° C. in the presence of ammonia.

2. The process of claim 1 in which said liquid containing said alkylaluminum amide is coated onto said substrate by spray coating, dip coating, flow coating, or spin coating.

3. The process of claim 1 in which said substrate is an electronic device.

4. The process of claim 1 in which said coating has a thickness of between about 50 to about 500 nanometers.

5. The process of claim 1 in which said alkylaluminum amide is diluted in a solution of an organic solvent.

6. A process for the formation of a multilayer ceramic or ceramic-like protective coating on a substrate comprising the steps of:

(I) (a) coating said substrate with a planarizing coating comprising a liquid containing an alkylaluminum amide having the formula $(R_2AlNH_2)_3$, where R is an alkyl group containing from 1 to 4 carbon atoms;

(b) drying said liquid and thereby depositing a preceramic coating on said substrate; and (c) ceramifying said preceramic coating to an aluminum nitride-containing ceramic by heating said preceramic coating to a temperature of between about 400° to about 1000° C. in the presence of ammonia to form said planarizing coating;

(II) applying to said planarizing coating a passivating coating selected from the group consisting of (i) a silicon nitrogen-containing coating, (ii) a silicon carbon-containing coating, and (iii) a silicon carbon nitrogen-containing coating; and (III) applying to said passivating coating a protective coating selected from the group consisting of (i) a silicon-containing coating, (ii) a silicon nitrogen-containing coating, (iii) a silicon carbon-containing coating, and (iv) a silicon carbon nitrogen-containing coating, whereby a multilayer ceramic or ceramic-like coating on said substrate is obtained.

7. The process of claim 6 in which said alkylaluminum amide is diluted in a solution of an organic solvent.

8. The process of claim 6 wherein in said passivating coating said silicon nitrogen-containing coating is applied onto said planarizing coating by a means selected from the group consisting of (a) chemical vapor deposition of a silane, halosilane, halodisilane, halopolysilane or mixtures thereof in the presence of ammonia, (b) plasma enhanced chemical vapor deposition of a silane, halosilane, halodisilane, halopolysilane or mixtures thereof in the presence of ammonia, (c) ceramification of a silicon and nitrogen-containing polymer; and wherein said silicon carbon nitrogen-containing coating is applied onto said planarizing coating by a means selected from the group consisting of (1) chemical vapor deposition of hexamethyldisilazane, (2) plasma enhanced chemical vapor deposition of hexamethyldisilazane, (3) chemical vapor deposition of a silane, halosilane, halodisilane, halopolysilane or mixture thereof in the presence of an alkane of one to six carbon atoms or an alkylsilane, and further in the presence of ammonia, and (4) plasma enhanced chemical vapor deposition of a silane, halosilane, halodisilane, halopolysilane or mixture thereof in the presence of an alkane of one to six carbon atoms or an alkylsilane, and further in the presence of ammonia; and wherein said silicon carbon-containing coating is deposited by a means selected from the group consisting of (i) chemical vapor deposition of a silane, halosilane, halopolysilane, or mixtures thereof in the presence of an alkane of one to six carbon atoms or an alkylsilane, and (ii) plasma enhanced chemical vapor deposition of a silane, alkylsilane, halosilane, halodisilane, halopolysilane, or mixtures thereof in the presence of an alkane of one to six carbon atoms or an alkylsilane, to produce said passivating coating.

9. The process of claim 6 wherein in said protective coating, said silicon-containing coating is applied onto said passivating coating by a means selected from the group consisting of (a) chemical vapor deposition of a silane, halosilane, halopolysilane, or mixtures thereof, (b) plasma enhanced chemical vapor deposition of a silane, halosilane, halopolysilane, or mixtures thereof, or (c) metal assisted chemical vapor deposition of a silane, halosilane, halopolysilane, or mixtures thereof; and wherein said silicon carbon-containing coating is applied by a means selected from the group consisting of (1) chemical vapor deposition of a silane, alkylsilane, halosilane, halodisilane, halopolysilane, or mixtures thereof in the presence of an alkane of one to six carbon atoms or an alkylsilane, (2) plasma enhanced chemical vapor deposition of a silane, alkylsilane, halosilane, halodisilane, halopolysilane, or mixtures thereof in the presence of an alkane of one to six carbon atoms or an alkylsilane; and wherein said silicon nitrogen-containing coating is deposited by a means selected from the group consisting of (A) chemical vapor deposition of a silane, halosilane, halodisilane, halopolysilane, or mixtures thereof in the presence of ammonia, (B) plasma enhanced chemical vapor deposition of a silane, halosilane, halodisilane, halopolysilane or mixtures thereof in the presence of ammonia, and (C) ceramification of a silicon and nitrogen-containing preceramic polymer; and wherein said silicon carbon nitrogen-containing coating is deposited by a means selected from the group consisting of (i) chemical vapor deposition of hexamethyldisilazane, (ii) plasma enhanced chemical vapor deposition of hexamethyldisilazane, (iii) chemical vapor deposition of a silane, alkylsilane, halosilane, halodisilane, halopolysilane, or mixtures thereof in the presence of an alkane of one to six carbon atoms or an alkylsilane and further in the presence of ammonia, and (iv) plasma enhanced chemical vapor deposition of a silane, alkylsilane, halosilane, halodisilane, halopolysilane, or mixtures thereof in the presence of an alkane of one to presence of ammonia, to produce said protective coating.

10. The process of claim 6 in which said liquid containing said alkylaluminum amide is coated onto said substrate by spray coating, dip coating, flow coating, or spin coating.

11. The process of claim 6 in which said substrate is an electronic device.

12. A process for the formation of a multilayer ceramic or ceramic-like protective coating on a substrate comprising the steps of:

(I) coating said substrate with a planarizing coating of a silicon dioxide containing ceramic or ceramic-like composition;

(II) (a) applying to said planarizing coating a passivating coating comprising a liquid containing an alkylaluminum amide having the formula $(R_2AlNH_2)_3$, where R is an alkyl group containing from 1 to 4 carbon atoms;

(b) drying said liquid and thereby depositing a preceramic coating on said substrate; and (c) ceramifying said preceramic coating to an aluminum nitride-containing ceramic by heating said preceramic coating to a temperature of between about 400° to about 1000° C. in the presence of ammonia to form said passivating coating; and (III) applying to said passivating coating a protective coating selected from the group consisting of (i) a silicon-containing coating, (ii) a silicon nitrogen-containing coating, (iii) a silicon carbon-containing coating, and (iv) a silicon carbon nitrogen-containing coating, whereby a multilayer ceramic or ceramic-like coating on said substrate is obtained.

13. The process of claim 12 in which said alkylaluminum amide is diluted in a solution of an organic solvent.

14. The process of claim 12 wherein in said planarizing coating, said silicon dioxide containing ceramic or ceramic-like composition is applied onto said substrate by a means selected from the group consisting of (a) deposition of a hydrogen silsesquioxane resin from a solvent solution, with or without a catalyst, drying, and ceramification, (b) deposition of a mixture of a hydrogen silsesquioxane resin and one or more metal oxides from a solvent solution, with or without a catalyst, drying, and ceramification, (c) deposition of a silicate ester from a solvent solution, drying, and ceramification, (d) deposition of a mixture of a silicate ester and one or more metal oxides from a solvent solution, drying, and ceramification, (e) deposition of a nitrided hydrogen silsesquioxane resin from a solvent solution, with or without a catalyst, drying, and ceramification, and (f) deposition of a mixture of a nitrided hydrogen silsesquioxane resin and one or more metal oxides from a solvent solution, with or without a catalyst, drying, and ceramification.

15. The process of claim 12 wherein in said protective coating, said silicon-containing coating is applied onto said passivating coating by a means selected from the group consisting of (a) chemical vapor deposition of a silane, halosilane, halopolysilane, or mixtures thereof, (b) plasma enhanced chemical vapor deposition of a silane, halosilane, halopolysilane, or mixtures thereof, or (c) metal assisted chemical vapor deposition of a silane, halosilane, halopolysilane, or mixtures thereof; and wherein said silicon carbon-containing coating is applied by a means selected from the group consisting of (1) chemical vapor deposition of a silane, alkylsilane, halosilane, halodisilane, halopolysilane, or mixtures thereof in the presence of an alkane of one to six carbon atoms or an alkylsilane, (2) plasma enhanced chemical vapor deposition of a silane, alkylsilane, halosilane, halodisilane, halopolysilane, or mixtures thereof in the presence of an alkane of one to six carbon atoms or an alkylsilane; and wherein said silicon nitrogen-containing coating is deposited by a means selected from the group consisting of (A) chemical vapor deposition of a silane, halosilane, halodisilane, halopolysilane or mixtures thereof in the presence of ammonia, (B) plasma enhanced chemical vapor deposition of a silane, halosilane, halodisilane, halopolysilane or mixtures thereof in the presence of ammonia, and (C) ceramification of a silicon and nitrogen-containing preceramic polymer; and wherein said silicon carbon nitrogen-containing coating is deposited by a means selected from the group consisting of (i) chemical vapor deposition of hexamethyldisilazane, (ii) plasma enhanced chemical vapor deposition of hexamethyldisilazane, (iii) chemical vapor deposition of a silane, alkylsilane, halosilane, halodisilane, halopolysilane, or mixtures thereof in the presence of an alkane of one to six carbon atoms or an alkylsilane and further in the presence of ammonia, and (iv) plasma enhanced chemical vapor deposition of a silane, alkylsilane, halosilane, halodisilane, halopolysilane, or mixtures thereof in the presence of an alkane of one to six carbon atoms or an alkylsilane and further in the presence of ammonia, to produce said protective coating.

16. The process of claim 12 in which said liquid containing said alkylaluminum amide is coated onto said planarizing coating by spray coating, dip coating, flow coating, or spin coating.

17. The process of claim 12 in which said substrate is an electronic device.

18. A process for the formation of a multilayer ceramic or ceramic-like protective coating on a substrate comprising the steps of:

(I) coating said substrate with a planarizing coating of a silicon dioxide containing ceramic or ceramic-like composition;

(II) (a) applying to said planarizing coating a passivating coating selected from the group consisting of (i) a silicon nitrogen-containing coating, (ii) a silicon carbon-containing coating, and (iii) a silicon carbon nitrogen-containing coating; and (III) applying to said passivating coating a protective coating of aluminum nitride by the chemical vapor deposition of a preceramic composition containing an alkylaluminum amide having the formula $(R_2AlNH_2)_3$, where R is an alkyl group containing from 1 to 4 carbon atoms at a temperature of between about 400° to about 1000° C. in the presence of ammonia to form said protective coating.

19. The process of claim 18 wherein in said planarizing coating, said silicon dioxide containing ceramic or ceramic-like composition is applied onto said substrate by a means selected from the group consisting of (a) deposition of a hydrogen silsesquioxane resin from a solvent solution, with or without a catalyst, drying, and ceramification, (b) deposition of a mixture of a hydrogen silsesquioxane resin and one or more metal oxides from a solvent solution, with or without a catalyst, drying, and ceramification, (c) deposition of a silicate ester from a solvent solution, drying, and ceramification, (d) deposition of a mixture of a silicate ester and one or more metal oxides from a solvent solution, drying, and ceramification, (e) deposition of a nitrided hydrogen silsesquioxane resin from a solvent solution, with or without a catalyst, drying, and ceramification, and (f) deposition of a mixture of a nitrided hydrogen silsesquioxane resin and one or more metal oxides from a solvent solution, with or without a catalyst, drying, and ceramification.

20. The process of claim 18 wherein in said

The process of claim 24 wherein in said passivating coating said silicon nitrogen-containing coating is applied onto said planarizing coating by a means selected from the group consisting of (a) chemical vapor deposition of a silane, halosilane, halodisilane, halopolysilane or mixtures thereof in the presence of ammonia, (b) plasma enhanced chemical vapor deposition of a silane, halosilane, halodisilane, halopolysilane or mixtures thereof in the presence of ammonia, (c) ceramification of a silicon and nitrogen-containing polymer; and wherein said silicon carbon nitrogen-containing coating is applied onto said planarizing coating by a means selected from the group consisting of (1) chemical vapor deposition of hexamethyldisilazane, (2) plasma enhanced chemical vapor deposition of hexamethyldisilazane, (3) chemical vapor deposition of a silane, halosilane, halodisilane, halopolysilane or mixture thereof in the presence of an alkane of one to six carbon atoms or an alkylsilane, and further in the presence of ammonia, and (4) plasma enhanced chemical vapor deposition of a silane, halosilane, halodisilane, halopolysilane or mixture thereof in the presence of an alkane of one to six carbon atoms or an alkylsilane, and further in the presence of ammonia; and wherein said silicon carbon-containing coating is deposited by a means selected from the group consisting of (i) chemical vapor deposition of a silane, halosilane, halopolysilane, or mixtures thereof in the presence of an alkane of one to six carbon atoms or an alkylsilane, and (ii) plasma enhanced chemical vapor deposition of a silane, alkylsilane, halosilane, halodisilane, halopolysilane, or mixtures thereof in the presence of an alkane of one to six carbon atoms or an alkylsilane, to produce said passivating coating.

21. The process of claim 18 in which said substrate is an electronic device.

22. A process for the formation of a multilayer ceramic or ceramic-like protective coating on a substrate comprising the steps of:

(I) coating said substrate with an initial coating of a ceramic or ceramic-like composition selected from the group consisting of (i) a silicon nitrogen-containing coating, (ii) a silicon carbon-containing coating, and (iii) a silicon carbon nitrogen-containing coating and;

(II) (a) applying to said initial coating a passivating coating comprising a liquid containing an alkylaluminum amide having the formula $(R_2AlNH_2)_3$, where R is an alkyl group containing from 1 to 4 carbon atoms;

(b) drying said liquid and thereby depositing a preceramic coating on said substrate; and (c) ceramifying said preceramic coating to an aluminum nitride-containing ceramic by heating said preceramic coating to a temperature of between about 400° to about 1000° C. in the presence of ammonia to form said passivating coating; and (III) applying to said passivating coating a protective coating selected from the group consisting of (i) a silicon-containing coating, (ii) a silicon nitrogen-containing coating, (iii) a silicon carbon-containing coating, and (iv) a silicon carbon nitrogen-containing coating, whereby a multilayer ceramic 23. The process of claim 22 in which said alkylaluminum amide is diluted in a solution of an organic solvent.

24. The process of claim 22 wherein in said protective coating, said silicon-containing coating is applied onto said passivating coating by a means selected from the group consisting of (a) chemical vapor deposition of a silane, halosilane, halopolysilane, or mixtures thereof, (b) plasma enhanced chemical vapor deposition of a silane, halosilane, halopolysilane, or mixtures thereof, or (c) metal assisted chemical vapor deposition of a silane, halosilane, halopolysilane, or mixtures thereof; and wherein said silicon carbon-containing coating is applied by a means selected from the group consisting of (1) chemical vapor deposition of a silane, alkylsilane, halosilane, halodisilane, halopolysilane, or mixtures thereof in the presence of an alkane of one to six carbon atoms or an alkylsilane, (2) plasma enhanced chemical vapor deposition of a silane, alkylsilane, halosilane, halodisilane, halopolysilane, or mixtures thereof in the presence of an alkane of one to six carbon atoms or an alkylsilane; and wherein said silicon nitrogen-containing coating is deposited by a means selected from the group consisting of (A) chemical vapor deposition of a silane, halosilane, halodisilane, halopolysilane or mixtures thereof in the presence of ammonia, (B) plasma enhanced chemical vapor deposition of a silane, halosilane, halodisilane, halopolysilane or mixtures thereof in the presence of ammonia, and (C) ceramification of a silicon and nitrogen-containing preceramic polymer; and wherein said silicon carbon nitrogen-containing coating is deposited by a means selected from the group consisting of (i) chemical vapor deposition of hexamethyldisilazane, (ii) plasma enhanced chemical vapor deposition of hexamethyldisilazane, (iii) chemical vapor deposition of a silane, alkylsilane, halosilane, halodisilane, halopolysilane, or mixtures thereof in the presence of an alkane of one to six carbon atoms or an alkylsilane and further in the presence of ammonia, and (iv) plasma enhanced chemical vapor deposition of a silane, alkylsilane, halosilane, halodisilane, halopolysilane, or mixtures thereof in the presence of an alkane of one to six carbon atoms or an alkylsilane and further in the presence of ammonia, to produce said protective coating.

25. The process of claim 22 in which said liquid containing said alkylaluminum amide is coated onto said planarizing coating by spray coating, dip coating, flow coating, or spin coating.

26. The process of claim 22 in which said substrate is an electronic device.

27. A process for the formation of a two layer ceramic or ceramic-like coating on a substrate comprising the steps of:

(I) (a) coating said substrate with a planarizing coating comprising a liquid containing an alkylaluminum amide having the formula $(R_2AlNH_2)_3$, where R is an alkyl group containing from 1 to 4 carbon atoms;

(b) drying said liquid and thereby depositing a preceramic coating on said substrate; and (c) ceramifying said preceramic coating to an aluminum nitride-containing ceramic by heating said preceramic coating to a temperature of between about 400° to about 1000° C. in the presence of a ammonia to form said planarizing coating; and (II) applying to said planarizing coating a passivating coating selected from the group consisting of (i) silicon nitrogen-containing coating, (ii) a silicon-containing coating, (iii) a silicon nitrogen-containing coating, and (iv) a silicon carbon nitrogen-containing coating, whereby a two layer ceramic or ceramic-like coating is obtained.

28. The process of claim 27 in which said alkylaluminum amide is diluted in a solution of an organic solvent.

29. The process of claim 27 wherein in said passivating coating said silicon-containing coating is applied onto said passivating coating by a means selected from the group consisting of (a) chemical vapor deposition of a silane, halosilane, halopolysilane, or mixtures thereof, (b) plasma enhanced chemical vapor deposition of a silane, halosilane, halopolysilane, or mixtures thereof, or (c) metal assisted chemical vapor deposition of a silane, halosilane, halopolysilane, or mixtures thereof; said silicon nitrogen-containing coating is applied onto said planarizing coating by a means selected from the group consisting of (a) chemical vapor deposition of a silane, halosilane, halodisilane, halopolysilane or mixtures thereof in the presence of ammonia, (b) plasma enhanced chemical vapor deposition of a silane, halosilane, halodisilane, halopolysilane or mixtures thereof in the presence of ammonia, (c) ceramification of a silicon and nitrogen-containing polymer; and wherein said silicon carbon nitrogen-containing coating is applied onto said planarizing coating by a means selected from the group consisting of (1) chemical vapor deposition of hexamethyldisilazane, (2) plasma enhanced chemical vapor deposition of hexamethyldisilazane, (3) chemical vapor deposition of a silane, halosilane, halodisilane, halopolysilane or mixture thereof in the presence of an alkane of one to six carbon atoms or an alkylsilane, and further in the presence of ammonia, and (4) plasma enhanced chemical vapor deposition of a silane, halosilane, halodisilane, halopolysilane or mixture thereof in the presence of an alkane of one to six carbon atoms or an alkylsilane, and further in the presence of ammonia; and wherein said silicon carbon-containing coating is deposited by a means selected from the group consisting of (i) chemical vapor deposition of a silane, halosilane, halopolysilane, or mixtures thereof in the presence of an alkane of one to six carbon atoms, to produce said passivating coating.

30. The process of claim 27 in which said solution containing said alkylaluminum amide is coated onto said substrate by spray coating, dip coating, flow coating, or spin coating.

31. The process of claim 27 in which said substrate is an electronic device.

32. A process for the formation of a two layer ceramic or ceramic-like protective coating on a substrate comprising the steps of:

(I) coating said substrate with a planarizing coating of a silicon dioxide containing ceramic or ceramic-like composition; and (II) applying to said passivating coating a protective coating of aluminum nitride by the chemical vapor deposition of a preceramic composition containing an alkylaluminum amide having the formula $(R_2AlNH_2)_3$, where R is an alkyl group containing from 1 to 4 carbon atoms at a temperature of between about 400° to about 1000° C. in the presence of ammonia to form said protective coating.

33. The process of claim 32 wherein in said planarizing coating, said silicon dioxide containing ceramic or ceramic-like composition is applied onto said substrate by a means selected from the group consisting of (a) deposition of a hydrogen silsesquioxane resin from a solvent solution, with or without a catalyst, drying, and ceramification, (b) deposition of a mixture of a hydrogen silsesquioxane resin and one or more metal oxides from a solvent solution, with or without a catalyst, drying, and ceramification, (c) deposition of a silicate ester from a solvent solution, drying, and ceramification, (d) deposition of a mixture of a silicate ester and one or more metal oxides from a solvent solution, drying, and ceramification, (e) deposition of a nitrided hydrogen silsesquioxane resin from a solvent solution, with or without a catalyst, drying, and ceramification, and (f) deposition of a mixture of a nitrided hydrogen silsesquioxane resin and one or more metal oxides from a solvent solution, with or without a catalyst, drying, and ceramification.

34. The process of claim 32 in which said substrate is an electronic device.

* * * * *